US006497291B1

(12) United States Patent
Szarka

(10) Patent No.: US 6,497,291 B1
(45) Date of Patent: Dec. 24, 2002

(54) FLOAT VALVE ASSEMBLY AND METHOD

(75) Inventor: David D. Szarka, Duncan, OK (US)

(73) Assignee: Halliburton Energy Services, Inc., Duncan, OK (US)

( * ) Notice: Subject to any disclaimer, the term of this patent is extended or adjusted under 35 U.S.C. 154(b) by 0 days.

(21) Appl. No.: 09/650,204

(22) Filed: Aug. 29, 2000

(51) Int. Cl.[7] ..... E21B 34/10

(52) U.S. Cl. ..... 166/386; 166/317; 166/387; 166/327

(58) Field of Search ..... 166/317, 386, 166/387, 325, 327, 319

(56) References Cited

U.S. PATENT DOCUMENTS

| | | | | |
|---|---|---|---|---|
| 3,957,114 | A | 5/1976 | Streich | 166/285 |
| 3,997,009 | A | 12/1976 | Fox | 175/107 |
| 4,067,358 | A | 1/1978 | Streich | 137/624.13 |
| 4,250,966 | A | 2/1981 | Streich et al. | 166/328 |
| 4,457,377 | A | 7/1984 | Burris, II | 166/332 |
| 4,615,394 | A | 10/1986 | Kuhlman, Jr. | 166/327 |
| 4,624,316 | A | 11/1986 | Baldridge et al. | 166/325 |
| 4,712,619 | A | 12/1987 | Stepp et al. | 166/327 |
| 4,729,432 | A | 3/1988 | Helms | 166/317 |
| 5,058,671 | A | 10/1991 | Cochran | 166/124 |
| 5,058,672 | A | * 10/1991 | Cochran | |
| 5,338,001 | A | 8/1994 | Godfrey et al. | 251/58 |
| 5,379,835 | A | 1/1995 | Streich | 166/181 |
| 5,450,903 | A | 9/1995 | Budde | 166/321 |
| 5,472,053 | A | 12/1995 | Sullaway et al. | 166/327 |
| 5,647,434 | A | 7/1997 | Sullaway et al. | 166/242.8 |
| 5,823,265 | A | 10/1998 | Crow et al. | 166/373 |

OTHER PUBLICATIONS

Baker Oil Tools brochure titled "Bakerline Model "F" Drill Pipe Float Valve" dated Mar. 30, 1981.

Halliburton Energy Services, Inc. brochure titled "Value Seal™ Floating Equipment" dated Feb. 1998.

Halliburton Energy Services, Inc. brochure titled "Advantage™ IPV Insert Poppet Valve" dated Nov. 1997.

Halliburton Energy Services, Inc. brochure titled "Super Seal™ II Floating Equipment" dated Nov. 1997.

Halliburton Energy Services, Inc. brochure titled "High Strength Float Equipment" dated May 1997.

Halliburton Energy Services, Inc. brochure titled "Super Seal™ II High Port Upjet Float Shoe" dated 1995.

Hilliburton Energy Services, Inc. brochure titled "Load Carrying Float Equipment" dated Jul. 1997.

* cited by examiner

*Primary Examiner*—Roger Schoeppel
(74) *Attorney, Agent, or Firm*—Craig W. Roddy; Loren G. Helmreich

(57) ABSTRACT

An improved float valve according to the present invention includes a packer 10 for positioning within a joint of the casing C while at the surface of the well, the packer including a float valve receptacle therein for at least partially receiving a float valve. The float valve body includes a valve seat 56 and a valve member 54 is positioned for selective engagement and disengagement with the valve seat. A guide nose 58 may be optionally provided for positioning within the casing joint between the valve body and the pin end of the casing joint. The float valve body may be reliably fixed and sealed to the packer body. After the packer setting operation, the casing joint and the packer and the float valve may then be positioned as an assembly within the well.

21 Claims, 5 Drawing Sheets

FLOAT VALVE ASSEMBLY AND METHOD

FIELD OF THE INVENTION

The present invention relates to float valves of the type commonly used in hydrocarbon recovery operations when conducting cementing operations. More particularly, the present invention relates to an improved float valve which may be reliably secured inside a tubular irrespective of the type of threads on the end of the tubular casing grade, and casing weight. This invention includes an improved method of reliably securing the float valve inside a tubular.

BACKGROUND OF THE INVENTION

Those familiar with hydrocarbon recovery operations appreciate the importance of reliably cementing the well casing within the hole. It is thus common practice within the cementing operations to install one or more float valves in the lower portion of the casing string. These float valves may be in the form of a float shoe or a float collar, and typically consist of a float valve housed within a steel casing which in turn becomes an integral portion of the casing string, i.e., the float valve housing is threaded between two joints of casing. The float valve is preferably fixed into the steel housing with a special blend of cement which subsequently facilitates drilling out the float valve.

Float shoes and float collars are thus commonly stocked by service companies in popular casing sizes, weights, and casing threads, which are conventionally either API 8-round or Buttress. A partially composite material or plastic material float valve body according to the prior art was thus conventionally secured to the steel housing with threads at both ends of the steel housing, with the float valve body being secured by a cement liner provided when the poured cement is cured to secure the float valve body to the steel housing. When the customer, typically an oil company, elects to use well casing that employs a non-API casing thread, special pieces of floating equipment may have to be custom built to match the casing size, weight, grade, and thread profile. In addition, if a stage cementing job is to be performed, additional float equipment commonly in the form of a baffle adapter must be supplied which is compatible with the particular casing string being used. These requirements interject significant expense in the cost of the well program and require pre-planning on the part of both the customer and the vendor of the float equipment to insure that the required equipment will be available when needed.

Prior art float valves are disclosed in U.S. Pat. Nos. 3,997,009 and 5,379,835. The Baker Line Model F Drill Pipe Float Valve is disclosed in Technical Manual Number 480-13. Valves and sealing assemblies commonly used in cementing operations are disclosed in U.S. Pat. Nos. 4,624,316 and 5,450,903.

The disadvantages of the prior art are overcome by the present invention. An improved float valve and technique for securing the float valve within the interior of a casing string is hereinafter disclosed. The float valve and technique of the present invention provide a universal float valve which may be used on a particular range of casing sizes and weights without regard to the casing thread type and pipe grade. The present invention provides a float valve with improved drill-out capability, high reliability, and reduced equipment inventory and rig-time costs compared to prior art equipment and techniques. The disadvantages of the prior art are thus overcome by the invention as described subsequently.

SUMMARY OF THE INVENTION

In a preferred embodiment, the basic components of the system include a modified composite packer, a plug seat, a float valve, and an optional guide nose. According to the method of the present invention, the drillable composite packer may be inserted into a joint of casing at the surface and then set utilizing a hydraulic setting tool. Once set, the setting mandrel and upper shoe may be retrieved from the joint of the casing, and the cannister type float valve then inserted into the receiving cavity of the body of the set packer. The float valve may be retained within the set packer by various conventional mechanisms including glue, a lock-ring, or threads. A hydraulic seal between the float valve body and the set packer may be effected by a glue joint and/or elastomeric seals. If the tool is to be used as a float shoe, a suitable composite nose piece with a desired shoe profile may be inserted into the pin end of the casing.

It is an object of the present invention to provide an improved float valve and a method of securing the float valve within a casing joint, wherein the float valve body may be reliably secured within a casing joint within manageable variations in the internal bore diameter of the casing joint, but also without regard to the threads at the ends of the casing joint being used. It is another object of the present invention to provide improved method of securing a float valve within a casing joint at the surface. The method offers the benefits of saving valuable rig time. The present invention may also eliminate the need to fixedly cement the float valve within the casing string.

Yet another object of the invention is to provide an improved float valve which is easily drillable after the cementing operation, utilizing a conventional PDC drill bit. It is a further object of the present invention to provide a float valve which may be used as either a float collar or a float shoe (with the addition of a nose profile), depending upon the desires of the operator.

It is an object of the present invention to provide an improved tool which replaces both conventional and specialized floating equipment and baffle adapter pieces. A single tool according to the invention is compatible for use in a range of oilfield casing sizes, irrespective of the weight, grade, or casing thread within the permissible size range of the given tool.

It is a feature of the invention that the universal aspects of this float valve significantly reduce inventory and the need to maintain stocks of equipment and drawings to support the myriad of possible casing threads, casing grades and weights, and combinations for each of the various casing sizes.

It is a further feature of the present invention that the components of the float valve preferably are formed of composite materials and little if any aluminum components are used, thereby enhancing the drillability of the float valve.

It is a further feature of the invention that the float valve has enhanced reliability by utilizing proven packer technology and reducing concerns about float body cement fracturing due to over-pressure.

It is a further feature that the method of the present invention streamlines manufacturing operations by eliminating the need to pour float body cement and maintain quality control on the cement product.

A significant advantage of the present invention is the high cost savings attained by using universal downhole equipment rather than equipment which inherently must be configured to threadably mate with the threads of the various weights and thread profiles of the different casing strings.

These and further objects, features, and advantages of the present invention will become apparent from the following detailed description, wherein reference is made to the figures in the accompanying drawings.

DETAILED DESCRIPTION OF PREFERRED EMBODIMENTS

Figure 1:
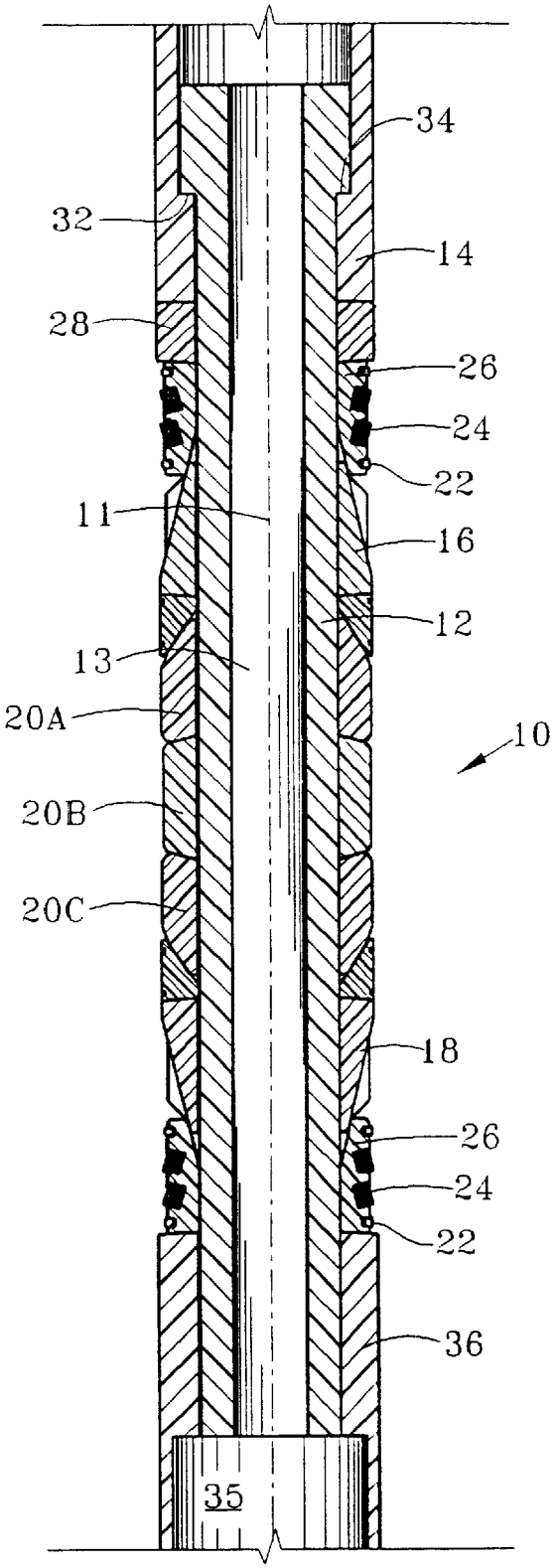
FIGS. 1 and 2 show the primary components of one embodiment of a float valve assembly according to the present invention in the unset position, including a drillable composite packer, composite plug seats, a float valve, and an optional guide nose.

FIG. 1 illustrates one embodiment of a packer 10 according to the present invention, comprising a packer mandrel 12 and a upper shoe body 14. The packer 10 may be a modified FASDRILL™ packer, and preferably is a drillable composite packer with a proven track record. Functional components of the packer 10 may includes an upper cone member 16 and a lower cone member 18. The elastomeric packer element shown include packer elements 20A, 20B, and 20C. While a three-piece packer element assembly is disclosed, those skilled in the art will appreciate that a packer with a single or multiple packer elements may be provided with limited clearance packer shoes capable of meeting the differential pressure requirements of conventional packer equipment. The packer 10 also includes circumferentially positioned upper and lower slips 26, with each of the slips including conventional gripping elements 24 for gripping engagement within a selected casing joint. Each of the upper and lower slips 26 may also include upper and lower slip bands 22 to initially hold the slip segments in place. The bands 22 are thus broken when the slips are "set".

Figure 2:
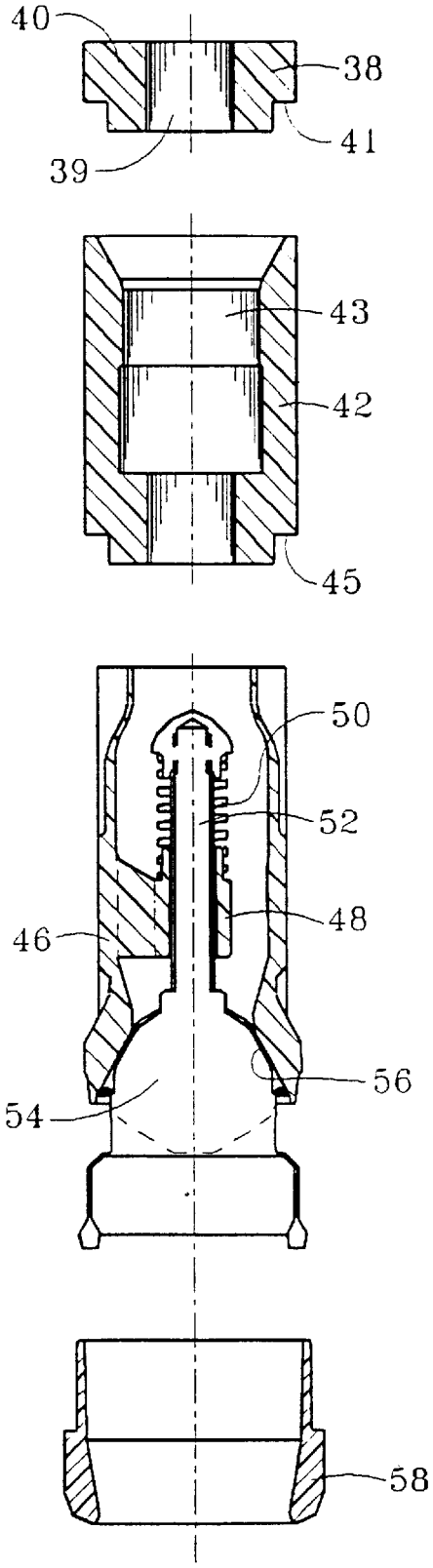
Figure 7:
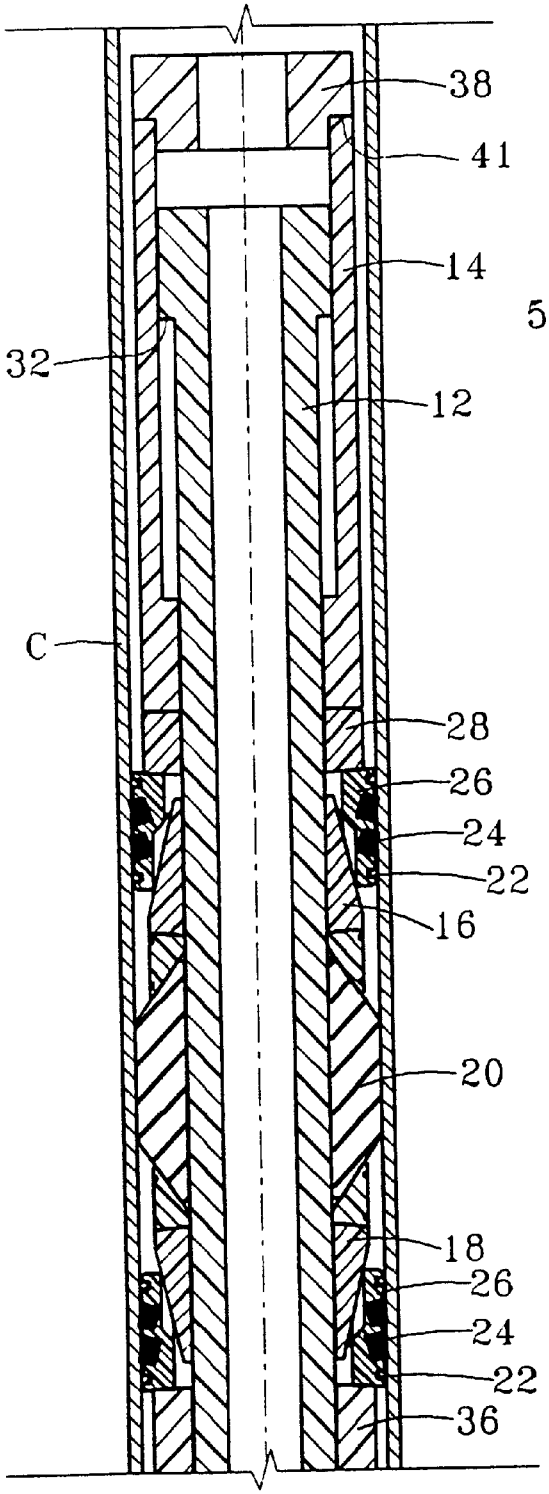
FIGS. 7 and 8 are cross sectional views of a float shoe which has been set within a selected joint of casing.
Figure 8:
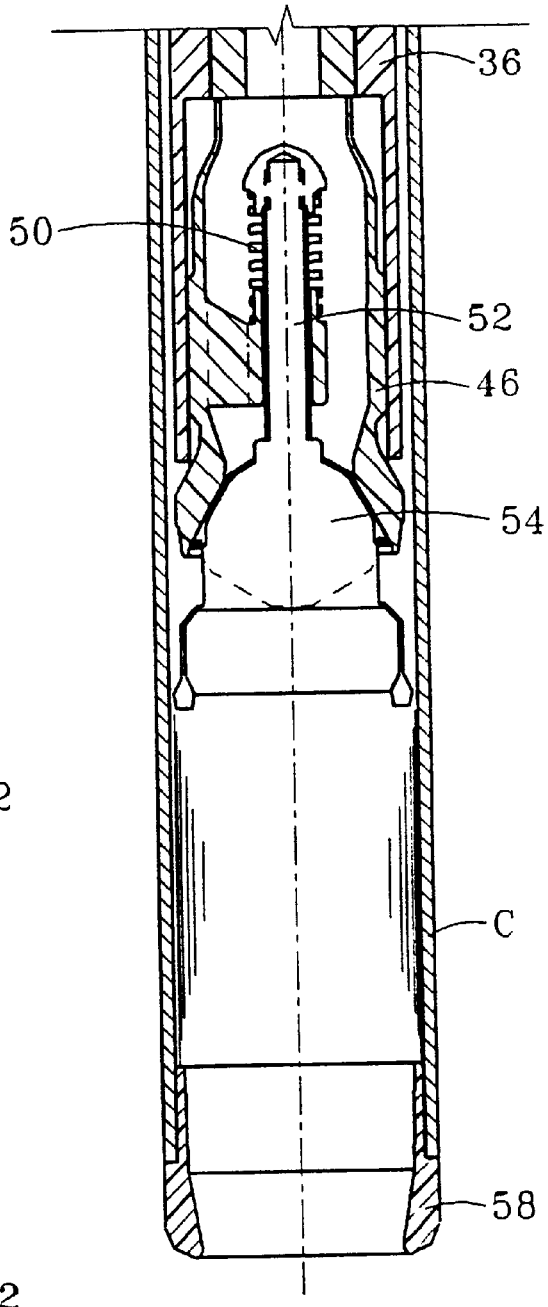

The packer mandrel 12 extends within a setting sleeve 36 which is discussed further below. The assembly as shown in FIG. 2 includes a plug seat 38 which includes a drillable material body 40, a supporting shoulder 41, and axial flow passage 39 extending therethrough. FIG. 2 also depicts a first stage shut-off plug seat 42 formed from a similar drillable material body with a lower supporting surface 45 and another axial passageway 43 therethrough. Those skilled in the art will appreciate that plug seat 42 is an alternative to the plug seat 38, in that either plug, when used, would be positioned above the packer mandrel 12 as shown in FIG. 1. FIG. 7 illustrates, for example, the plug seat 38 with shoulder 41 in engagement with the upper shoe body 14, which as explained subsequently is also a setting sleeve. The plug seat 38 may be in the form of a conventional flat face seat for a Type 5-W cementing plug. Alternatively, a plug seat may be intended for use with a Type NR seat. In still a further alternative, the plug seat may include a tapered plug body 42 with a latch down capability for use with cementing first stage shut-off plugs and/or Halliburton Type H SR first stage shut-off plugs.

The float valve body 46 may be formed from a composite material to facilitate ease of a subsequent drill-out operation. The composite material body includes a center guide 48 for receiving a valve stem 52 a valve body 54. A biasing member 50 may be provided, as shown. A valve body 54 may thus be moved into and out of sealing engagement with valve seat 56 for opening and closing the float valve. Finally, FIG. 2 depicts one type of a optional nose component for use of the assembly as a float shoe.

The float valve as shown in FIG. 2 may include a body 46 of the Halliburton Super Seal II type. While this type of float valve is shown as a preferred embodiment, the invention is not limited to this type float valve. In general, a float valve may be of a poppet of flapper valve type or a caged ball having a specific gravity less than common well fluids. All these types of float valve are well known to the industry and may be used according to the present invention. As described subsequently, the body 46 may be wrapped to a constant OD with a fiberglass or other composite material so that it may be inserted into and retained within the set packer. If the assembly is to be used as a float shoe, a suitable composite nose piece 58 may be inserted and retained in the pin end of the casing joint. Those skilled in the art will thus appreciate that while conventional nose piece 58 is shown in the drawing, the selected guide nose member or nose includes a fluid passageway therethrough and may be constructed as a high port up-jet, a down-jet, or any other float shoe nose configuration currently offered by oilfield supply manufacturers. FIGS. 1 and 2 thus depict an insertable float assembly prior to insertion into a selected casing joint.

Figure 3:
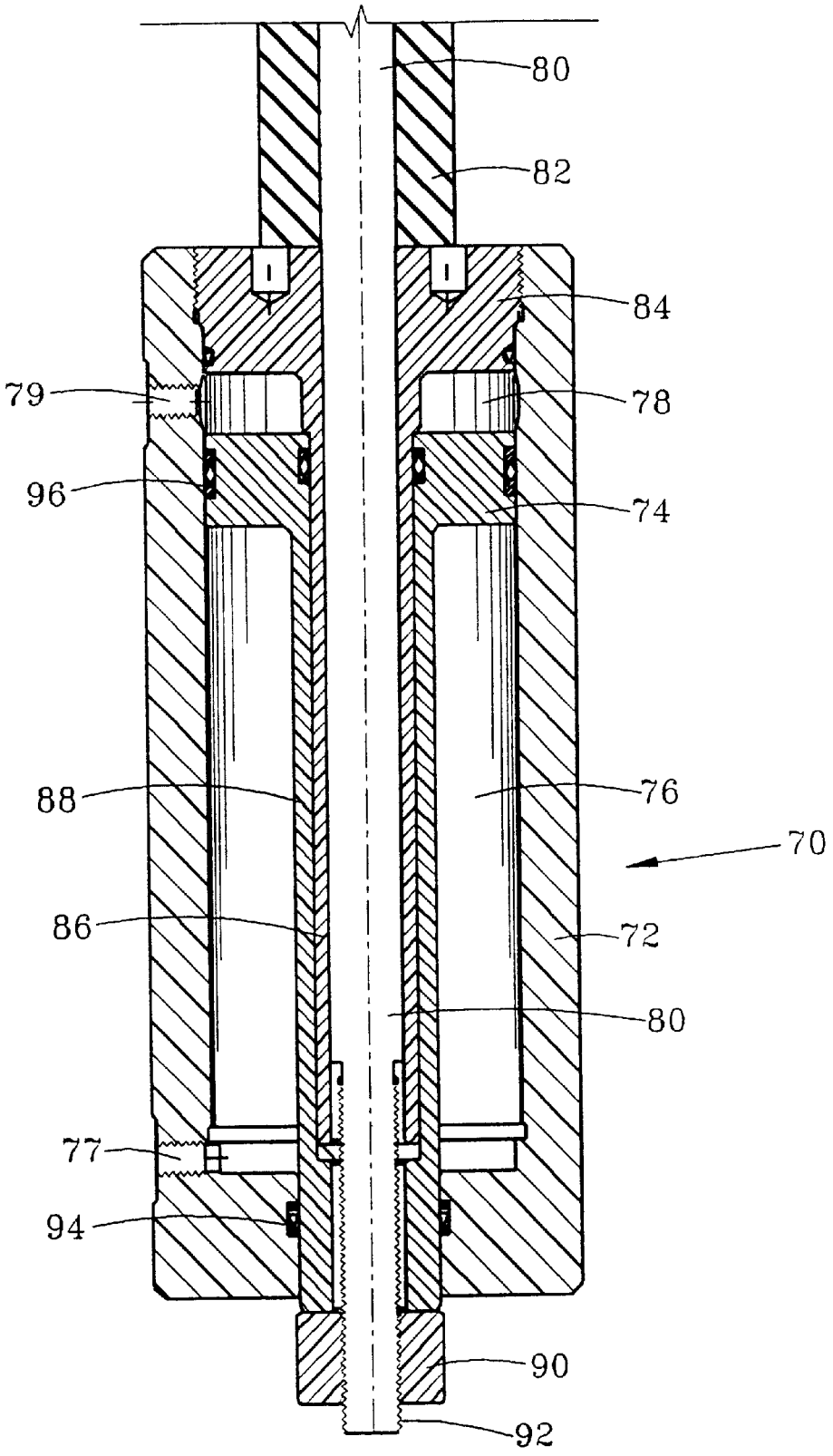
FIG. 3 is a cross sectional view of a tool which may be used at the surface for setting the packer as shown in FIGS. 1 and 2 within a selected joint of casing.

FIG. 3 depicts one embodiment of a suitable hydraulic jack 70, including a jack body 72. Piston 74 axially moves within the body 72, and separates chamber 78 from chamber 76. Piston 74 may thus include conventional sealing members 96 to provide sealing engagement between the piston and jack body 72 and inner sleeve 86, which is fixed to end cap 84 threadably secured to jack body 72. As shown in FIG. 3, the jack body 72 may include a conventional fill port 79 for selectively removing or adding fluid to the chamber 78. Port 77 is also shown in the body 72 for selective communication between the exterior of the jack body 72 and the interior chamber 76. Elongate sleeve 86 is thus fixed relative to piston sleeve 88. Sleeve 86 receives a setting mandrel 80 therein. Spacer 82 in engagement with end cap 84 also includes a central passageway for receiving the setting mandrel 80.

The setting mandrel 80 as shown in FIG. 2 includes a threaded end 92 for engagement with a conventional nut 90 so that the desired torque may be applied to the nut to create a desired axial force between the mandrel 80 and the piston 74. A conventional seal 94 maintains sealing engagement between the jack body 72 and the piston sleeve 88.

Figure 4:
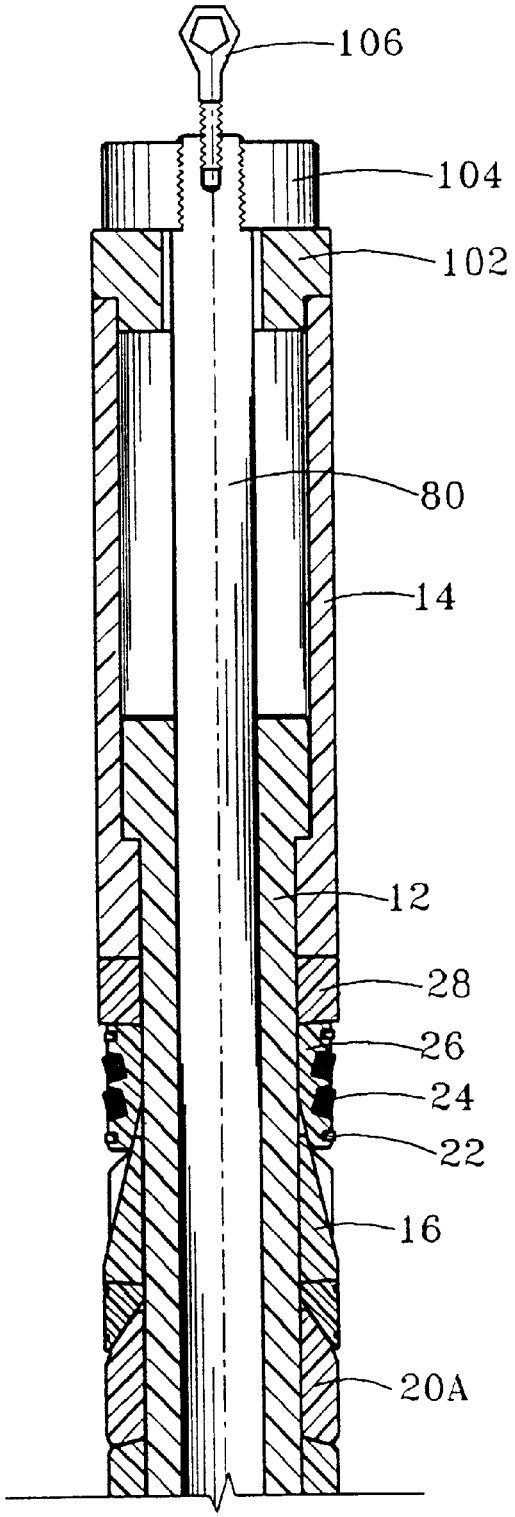
FIGS. 4, 5, and 6 are cross sectional views of an assembly including a float valve assembly as shown in FIGS. 1 and 2 and a tool as shown in FIG. 3, including a setting mandrel passing through a tool which has moved in response to hydraulic pressure from the position as shown in FIG. 3 to the position as shown in FIG. 6.
Figure 5:
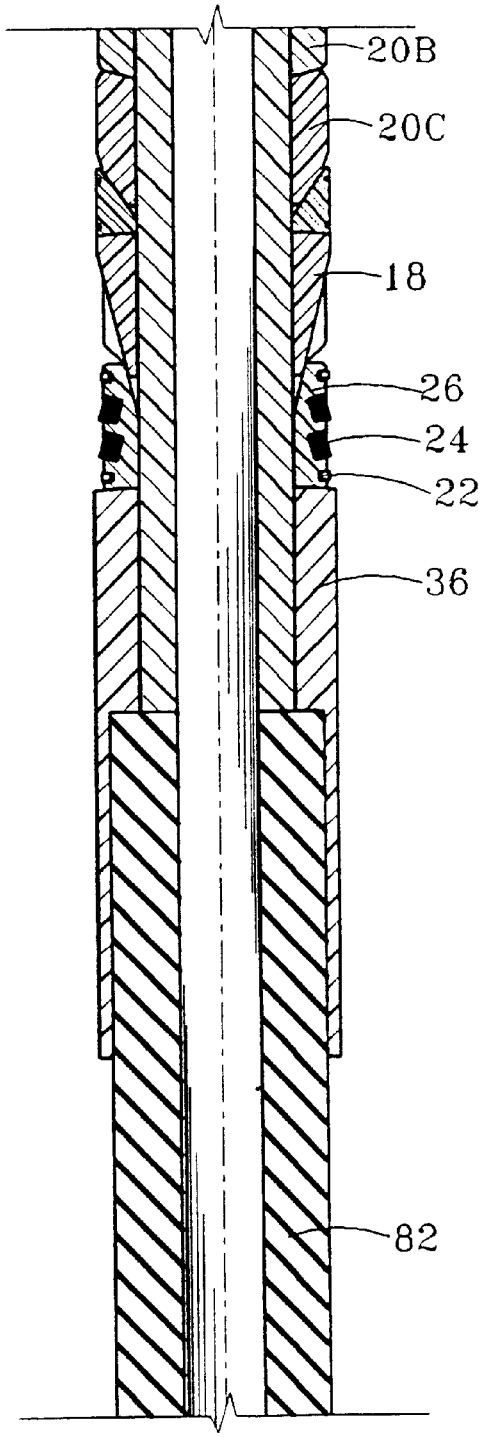
Figure 6:
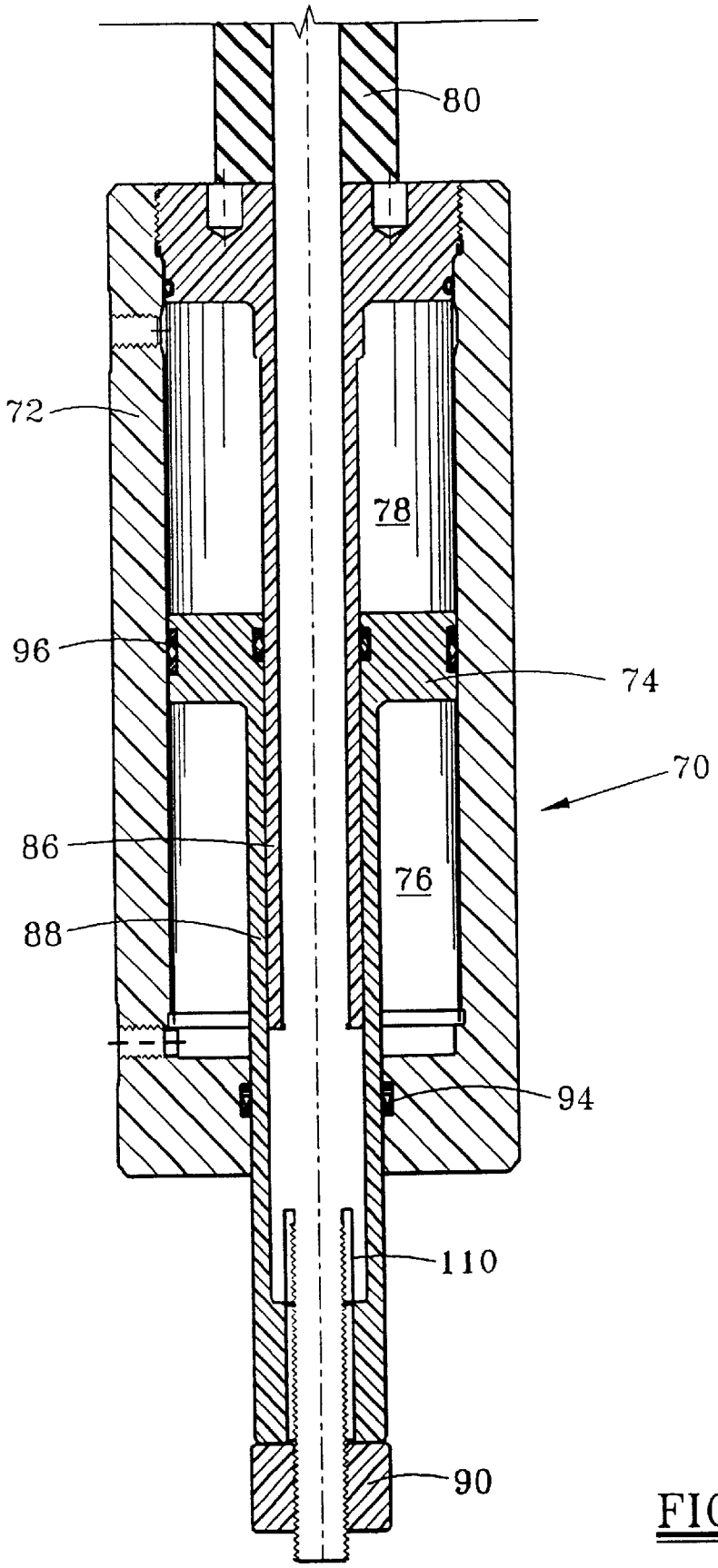

FIGS. 4 and 5 depict the packer elements 20A, 20B, and 20C previously discussed. An upper packer ring member 28 may be provided for engagement with packer mandrel 12. Upper shoe body 14 thus receives the setting mandrel 80. Plug seat 102 may be provided at the end of the upper shoe body 14, with a setting mandrel having a lower face 104 compatible to the plug seat profile chosen for use in the assembly. A conventional eye bolt 106 may be threaded onto the upper end of the setting mandrel 80 and/or the end cap 104. Prior to inserting the assembly into the pin end of a selected casing joint, a semi-rigid wire, such as an electrical conductors "fish tape", may be run through the casing joint from the box end and attached to the eye of the bolt 106 and thus to the setting mandrel so that the mandrel subsequently may be retrieved from the casing joint after setting the packer.

From the above, those skilled in the art will appreciate that the present invention embodies a method and an apparatus for supplying a tool insertable into a casing joint which may be used as a stand-alone float valve or may be adapted to supply a combination float valve/baffle adapter for use with conventional single and/or multiple stage cementing equipment. The packer serves the purpose of forming a mechanical or gripping engagement with the selected casing joint, and also a sealing engagement with the selected casing joint through the use of one or more conventional packer elements. The float valve assembly as described herein has the added value of being fully PDC drillable by eliminating the use of aluminum material found in many conventional pieces of floating equipment/baffle adapters. Those skilled in the art appreciate that an aluminum material, while generally thought to be an easy material to drill, is much more difficult to drill downhole than composite materials.

Those skilled in the art will appreciate that the present invention may be used in conjunction with plug seats as shown herein or with baffle adapters, and may be used in multi-stage cementing or in the absence of float equipment. The plug seat may thus be replaced with a baffle adapter for receiving baffle-type top plug and latch down plugs. A baffle adapter may also be provided on the packer assembly to facilitate an inner string cementing technique.

In a preferred embodiment, the float valve assembly thus includes a modified packer mandrel and a setting sleeve. A modified lower body may be glued, pinned, or otherwise secured to the lower end of the packer mandrel and is capable of accepting the cannister-shaped float valve assembly, including the body composite 46.

According to the method of the invention, a selected packer having a float valve receptacle therein may thus be inserted into a selected casing joint. After the packer has been hydraulically set in a casing joint and installed in a well, a pre-selected plug seat or baffle adapter compatible with the end use of the assembly may be selected and inserted into the upper end of the setting sleeve. The plug seat or baffle adapter may be retained by various mechanisms, including a glue joint, one or more pins, threading, and/or a lock ring. A suitable spacer may then be inserted into the valve cavity at the lower packer body. A setting mandrel with a desired upper shoe may be inserted through the assembly and the spacer, and a hollow core hydraulic jack 70 then slipped over the lower end of the setting mandrel. The nut may then be tightened sufficiently to render the assembly rigid. As previously noted, a desired semi-rigid wire may be connected to the eye of the bolt 106 shown in FIG. 4.

The packer 10 and the jack assembly 70 together may then be inserted into the pin end of the casing joint at any desired distance, as governed by the spacer length. The packer may be set by applying hydraulic pressure to the jack 70 through port 79. Once the packer has been set with a predetermined fluid pressure and thus a predetermined force, the jam nut may be removed from the jack end of the setting mandrel and the jack then removed after relaxing hydraulic force/pressure. The setting mandrel and the upper shoe may be retrieved from the casing joint by being withdrawn from the box end of the casing joint with the "fish tape" attached to the eye bolt 106. The cannister-type valve body 46 may then be inserted into the valve receptacle 35 in the packer and may be retained to the packer by a glue joint, by threaded engagement, by a lock ring, by a combination of these mechanical mechanisms, or by other conventional mechanical connection mechanisms. The hydraulic seal between the valve body 46 and the packer may be effected by a glue joint and/or one or more elastomeric seals. In a preferred embodiment, the float valve may be wrapped to a constant outer diameter with a composite material, such as fiberglass, so that it may be inserted into and retained within a valve cavity within the lower end of the set packer assembly. Packer mandrel 12 is permanently attached to setting sleeve 36 during construction. If the assembly is to be used as a float shoe, a suitable composite guide shoe may be inserted into the pin end of the casing. The assembly may be fully compatible with flush line casing. A shoe or guide nose 58 may be slipped over the OD of the pin of the rather than being inserted in the ID of the casing joint. The guide nose may be retained to the casing joint by glue, by threads, and/or by pinning.

The composite body 46 as disclosed herein may be wrapped with fiberglass to a desired OD, and then inserted into the float valve receptacle 35 in the lower end of the packer. The lower end of FIG. 1 thus depicts a portion of the valve receiving cavity 35 in the setting sleeve 36. The float valve may be secured both mechanically and sealingly within the float valve receptacle by any suitable technique. The float valve body 46 is preferably fabricated from a composite or plastic material. A "composite material," as that term is used herein, means a non-metallic plastic, thermoplastic, thermoset, resin, carbon-fiber epoxy, or other non-metallic man-made material, which optionally may include a metal component. A composite material body with a fiberglass wrapping offers an easily drillable, highly reliable, and cost effective technique for mechanically and sealingly connecting the float valve body and the packer. A wrapping with fiberglass, or another suitable composite material, may be used to form the sealed mechanical connection. Various other mechanisms or combination of mechanisms may be used to achieve this sealed mechanical connection. A composite material body alternatively may be formed from a plastic material, from a carbon-based material, or a carbon fiber composite material. The selected composite material will depend to some extent upon the anticipated downhole conditions.

A hydraulic setting tool is disclosed herein, although in less preferred embodiments mechanical mechanism may be used for setting the packer in the casing joint. The packer setting operation is thus provided at or near the surface, and any packer may used which provides the desired mechanical interconnection of the packer to the selected casing joint and the sealing engagement of the packer with the casing joint, with the packer providing the required support for the float valve. As an alternative to the hydraulic jack 70 disclosed herein, a mechanical jack may thus be used to set the packer in the desired casing joint. A mechanical packer setting mechanism may, for example, include a ratchet mechanism to facilitate setting of the packer in the casing joint at the surface. Some type of pull wire is preferably used for retrieving the desired component before inserting the set packer assembly and float valve in the well. Other less desirable techniques could be used to remove these components from the interior of the casing joint once their purpose is fulfilled. Less desirably, these components could, for example, thus free-fall from the interior of the casing joint at the desired stage of the operation.

The purpose of the spacer shown between the hydraulic jack body and the packer is to compensate for the travel of the floating mandrel of the packer. This compensation is only required if the device is to be used as a float shoe. In the event that the floating mandrel should shift to its downwardmost position, there should be sufficient space such that the float valve will not contact the upper end of the shoe profile. If the assembly is to be used as a float collar, the packer may be set such that the end of the float valve is flush with the end of the casing joint. Alternatively, the float valve body may be positioned at any reasonable location within the casing joint.

The assembly as disclosed herein offers several significant advantages over conventional equipment. These advantages include a float valve which is fully PDC drillable, with a proven quick drill-out time due in large part to the composite material body. The assembly may be used as a float collar, or as a float shoe with the addition of the guide nose member. The guide nose member or nose piece, which is preferably formed from a composite material, enhances use of the assembly as a float shoe. The guide nose may be configured for directing the fluid jet up, down or in any selected radial direction.

Only one assembly is required per casing size, regardless of casing weight, grade or thread, thus resulting in a significant inventory reduction and reducing the need to maintain stocks of numerous float collars, float shoes, and baffle adapters. The invention as disclosed herein also eliminates the need for the manufacturer to maintain engineering drawings to support the various casing thread types, including manufacturers with different casing weight or casing thread types. As disclosed herein, aluminum components may be eliminated to enhance drillability. The same basic setting tool may be used to set all tools irrespective of casing size.

The float valve assembly provides enhanced reliability, since the float valve is retained in a packer which is proven technology, thereby eliminating concerns about float equipment cement fracturing due to over pressure. The invention also streamlines manufacturing by eliminating the need to pour cement and maintain quality control of the cement. The floating equipment may be pre-installed in the selected casing joint, thereby saving valuable rig time.

The float valve assembly also may thus be used with any style of plug seat or baffle adapters. The packer may be provided with conventional circumferentially spaced slips or other members for gripping engagement with the selected casing joint. Internal components within the packer are preferably formed from material which will facilitate the subsequent drill-out of the internal packer components. To further enhance drill-out of the plug, a non-rotating plug may be cemented in the tool. Those skilled in the art will appreciate that the assembly of the present invention may be easily customized with alternative equipment and options. The float valve assembly may thus be used as a multi-stage cementing tool to cement a stage plug in place at a desired location within the well. A conventional stage cementing mechanism may be used in cooperation with the float valve assembly stage tool and perform the desired cementing operation.

Various modifications to the float valve and to the method as disclosed herein should be apparent from the above description of preferred embodiments. Although the invention has thus been described in detail for these embodiments, it should be understood that this explanation is for illustration, and that the invention is not limited to these embodiments. Alternate components and operating techniques will be apparent to those skilled in the art in view of this disclosure. Additional modifications are thus contemplated and may be made without departing from the spirit of the invention, which is defined by the claims.

What is claimed is:

1. A float valve for use during a cementing operation within a well including a casing string, the float valve comprising:

a packer for positioning within a joint of the casing string while at the surface of the well, the packer including a float valve receptacle therein;

a plug seat for receiving a plug to prohibit fluid flow through the float valve; and the float valve including a valve body for positioning at least partially within the float valve receptacle in the packer, the valve body including a valve seat, and the float valve including a valve member for sealing engagement with the valve seat when in the closed position and spaced from the valve seat when in the opened position, said float valve being constructed substantially of a composite material.

2. The float valve as defined in claim 1, further comprising:

a guide nose for positioning at least partially between the pin end of the casing joint and the valve body.

3. The float valve as defined in claim 2, wherein the guide nose is formed from a composite material and has a selected port discharge.

4. The float valve as defined in claim 1, wherein the float valve body is in sealing engagement with the packer.

5. The float valve as defined in claim 4, wherein sealing engagement between the float valve body and the packer is provided by a fiberglass material which, when cured, also mechanically interconnects the float valve body and the packer.

6. The float valve as defined in claim 1, wherein the packer is substantially constructed of composite material.

7. The float valve as defined in claim 6, further comprising:

a hydraulic setting tool for hydraulically setting the packer at the surface within the casing joint.

8. The float valve as defined in claim 7, wherein a setting mandrel is removed from within the casing joint after the packer has been set and before the casing joint and packer are positioned within the well.

9. The float valve as defined in claim 1, wherein the packer includes circumferentially positioned slips for grippingly engaging the casing joint when the packer is set.

10. An improved method of operating a float valve within a casing string for performing a cementing operation, the method comprising:

setting a packer within a casing joint of the casing string at the surface of the well, the packer including a float valve receptacle therein;

positioning a float valve body at least partially within the float valve receptacle;

fixedly retaining the float valve body and the packer in the casing joint, the float valve body including a valve seat;

providing a valve member movably relative to the float valve body for sealing engagement with the valve seat when in the closed position and spaced from the valve seat when in the opened position; and positioning the casing joint with the packer and float valve body therein within the casing string and subsequently within the well for performing the cementing operation.

11. The method as defined in claim 10, further comprising:

positioning a guide nose adjacent a pin end of the casing joint.

12. The method as defined in claim further comprising:

forming the guide nose from a composite material; and thereafter drilling out the guide nose.

13. The method as defined in claim 10, further comprising:

sealingly engaging the float valve body and packer.

14. The method as defined in claim 13, further comprising:

securing the packer to the float valve body with fiberglass.

15. The method as defined in claim 10, further comprising:

setting the packer with a setting tool within the casing joint at the surface; and retrieving a setting mandrel from the casing joint before inserting the casing joint and the packer and the float valve in the casing string.

16. The method as defined in claim 10, further comprising:

forming internal components of the packer from a composite material; and subsequently drilling out the components of the packer.

17. The method as defined in claim 10, further comprising:

positioning circumferential slips on the packer; and setting the packer with the slips grippingly engaging the casing joint.

18. The method as defined in claim 10, wherein the float valve is retained within the float valve receptacle by at least one of a shear pin and a shear ring.

19. A float valve for use during a cementing operation within a well including a casing string, the float valve comprising:

a packer for positioning within a joint of the casing string while at the surface of the well, the packer including a float valve receptacle valve therein;

a plug seat for receiving a plug to prohibit fluid flow through the float valve;

the float valve including a valve body for positioning at least partially within the float valve receptacle in the packer, the valve body including a valve seat, and the float valve including a valve member for sealing engagement with the valve seat, when in the closed position and spaced from the valve seat when in the open position; and a guide nose for positioning at least partially between the pin and of the casing joint and the valve body, wherein the guide nose is formed from a composite material and has a selected port discharge.

20. A float valve for use during a cementing operation within a well including a casing string, the float valve comprising:

a packer for positioning within a joint of the casing string while at the surface of the well, the packer including a float valve receptacle therein;

a plug seat for receiving a plug to prohibit fluid flow through the float valve; and the float valve including a valve body for positioning at least partially within the float valve receptacle in the packer, the valve body including a valve seat, and the float valve including a valve member for sealing engagement with the valve seat when in the closed position and spaced from the valve seat when in the opened position and wherein the float valve body is in sealing engagement with the packer.

21. The float valve as defined in claim 20, wherein sealing engagement between the float valve body and the packer is provided by a fiber glass material which, when cured, also mechanically interconnects the float valve body and the packer.

* * * * *